US007432875B1

(12) United States Patent
Sergi

(10) Patent No.: US 7,432,875 B1
(45) Date of Patent: Oct. 7, 2008

(54) SYSTEM FOR ATTACHING THE MAST OF AN ANTENNA TO A SUPPORT POST

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 207 days.

(21) Appl. No.: 10/934,994

(22) Filed: Sep. 7, 2004

(51) Int. Cl.
*H01Q 1/12* (2006.01)
*H01Q 9/34* (2006.01)

(52) U.S. Cl. ..... 343/890; 343/874

(58) Field of Classification Search ..... 343/874, 343/878, 880, 882, 890, 875, 881
See application file for complete search history.

(56) References Cited

U.S. PATENT DOCUMENTS 5,721,558 A * 2/1998 Holemans ..... 343/895
6,361,007 B1 * 3/2002 Oby et al. ..... 248/285.1
6,982,680 B2 * 1/2006 Janoschka et al. ..... 343/878
7,004,043 B2 * 2/2006 Erel et al. ..... 74/89.23
7,015,872 B1 * 3/2006 Little ..... 343/890
2006/0026797 A1 * 2/2006 Coyle ..... 16/280

* cited by examiner

*Primary Examiner*—David H Vu
*Assistant Examiner*—Minh Dieu A
(74) *Attorney, Agent, or Firm*—Renner, Kenner, Greive, Bobak, Taylor & Weber

(57) ABSTRACT

A system (10) for attaching a mast (11) of an antenna to a support post (12) includes a base plate (13) connected to the post (12), and a bracket plate (14) carrying the mast (11) and tiltably mounted to the base plate (13) by a plurality of connecting components (21). Each connecting component includes a bolt (37), two of which are received through notches (18) formed in the plate (13) and one of which is received in each track (22, 23) formed in the plate (13). A nut (42) tightens each of the bolts (37) to attach the plate (14) to the plate (13). When the bolts (37) are loosened, the plate (14) may be lifted relative to the plate (13) to move the bolts (37) out to the notches (18). Thereafter, the plate (14) may be tilted relative to the plate (13) to pivot a bolt (37) in one of the tracks (23) about a bolt (37) positioned in a pivot point (27) of the other track (22) to lower the antenna to the ground where it may be conveniently serviced.

21 Claims, 4 Drawing Sheets

SYSTEM FOR ATTACHING THE MAST OF AN ANTENNA TO A SUPPORT POST

TECHNICAL FIELD

This invention relates to a system for attaching the mast of an antenna to a support post. More particularly, this invention relates to such a system whereby the mast can be tilted to allow the user to readily work on the antenna.

BACKGROUND ART

In vertical antennas, the antenna mast is usually mounted to a support post or stake which is positioned in the ground. When it becomes necessary to repair a damaged antenna, or if an adjustment of the tuning of the antenna must be made, the user must climb a ladder or employ some other type of elevating device, and then while positioned well above the ground, the user can attempt to perform the necessary tasks. Such is a tedious and potentially dangerous operation. Alternatively, the user could disassemble the mast from the post, carefully lower the antenna, and then perform the desired tasks while on the ground. Thereafter, the user would be required to perform the tedious task of raising the antenna and holding it in position while reattaching the mast to the support post.

The need exists, therefore, for a simple, efficient and safe system of mounting an antenna mast to a support post so that work can be performed on an antenna without the need to elevate oneself above the ground or the need to disassemble the antenna mast from the post.

DISCLOSURE OF THE INVENTION

It is thus an object of the present invention to provide a system for attaching the mast of an antenna to a support post.

It is another object of the present invention to provide a system, as above, in which the antenna can be serviced without the need to climb a ladder or otherwise elevate oneself.

It is an additional object of the present invention to provide a system, as above, in which the antenna can be serviced without detaching its mast from a support post.

It is a further object of the present invention to provide a system, as above, in which the mast of the antenna may be tilted relative to the post so that work on the antenna may be performed at the ground level.

It is yet another object of the present invention to provide a system, as above, which may be operated by one person.

These and other objects of the present invention, as well as the advantages thereof over existing prior art forms, which will become apparent from the description to follow, are accomplished by the improvements hereinafter described and claimed.

In general, a system for attaching the mast of an antenna to a support post made in accordance with one aspect of the present invention includes a first plate connected to the support post and a second plate carrying the mast. Means are provided to connect the first plate to the second plate and to allow the second plate to be pivoted relative to the first plate.

In accordance with another aspect of the present invention, the system includes a first plate connected to the support post and a second plate carrying the mast. A plurality of connecting components are provided for the plates such that the first plate may be attached to the second plate and such that the second plate may be allowed to pivot relative to the first plate.

According to another aspect of the present invention, the system includes a first plate connected to the support post and a second plate carrying the mast. The first plate has a first track defining a pivot point and a second track having an arcuate portion. A plurality of connecting components selectively connect the first plate to the second plate and allow the second plate to be pivoted relative to the first plate. One of the connecting components is in the first track and another connecting component is in the second track such that when the connecting components are not connecting the plates, the second plate can pivot relative to the first plate.

The present invention also includes a method of attaching the mast of an antenna to a support post. The method includes the steps of attaching a first plate to the post, attaching a second plate to the mast, and connecting the first plate to the second plate so that the second plate can either be attached to the first plate or pivoted relative to the first plate.

A preferred exemplary system for attaching the mast of an antenna to a support post made in accordance with the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
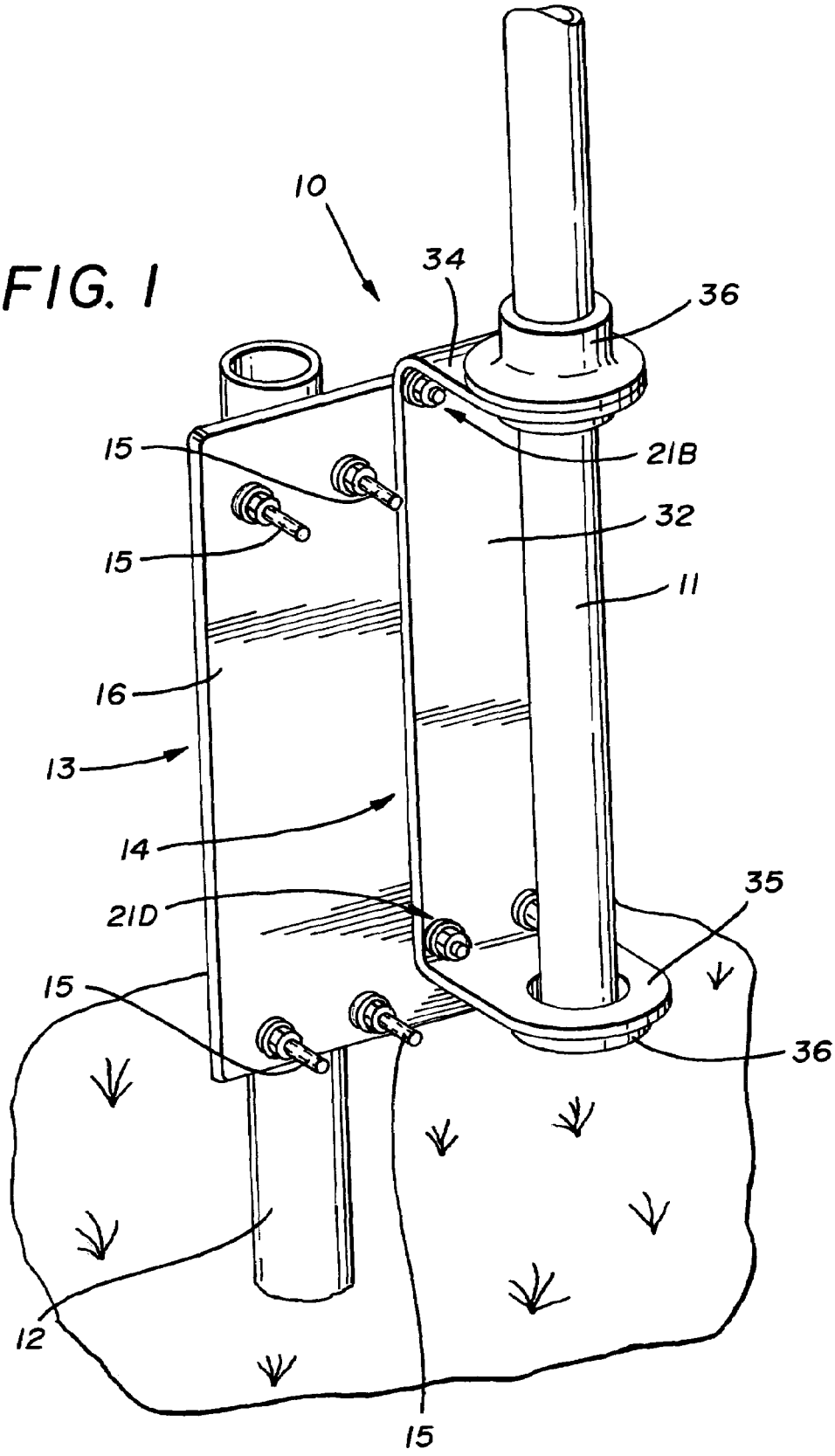
FIG. 1 is a fragmentary, front perspective view showing the system of the present invention being employed to mount the mast of an antenna to a support post positioned in the ground.

The present invention relates to a system, generally indicated by the numeral 10, for attaching the mast 11 of an antenna to a support post 12 mounted in the ground, while at the same time permitting the mast 11 to be tilted relative to the post 12. System 10 includes a base plate, generally indicated by the numeral 13, and a bracket plate, generally indicated by the numeral 14, and tiltably mounted to base plate 13.

Base plate 13 may be attached to support post 12 by a plurality (two shown) of conventional saddle clamps 15. As shown, support post 12 carries one end 16 of plate 13, and the other end 17 of plate 13 extends outwardly to the side of post 12. This end 17 is provided with two spaced notches 18 on the top edge 19 thereof. The bottoms 20 of notches 18 provide a resting point for connecting components, generally indicated by the numeral 21, to be hereinafter described in more detail. Specifically, connecting component 21A resides in one notch 18, and connecting component 21B resides in the other notch 18.

End 17 of plate 13 is also provided with a first track, generally indicated by the numeral 22, and a second track, generally indicated by the number 23. First track 22 includes a bottom resting point 24 for another connecting component 21C which is generally vertically aligned with one of the bottom resting points 20. First track 22 is generally J-shaped and thus includes a portion 25 extending generally vertically upward from bottom resting point 24, and a curved portion 26 extending from vertical portion 25 and ending at an upper resting point 27 for connecting component 21C.

Second track 23 includes a bottom resting point 28 for another connecting component 21D. Resting point 28 is generally horizontally aligned with resting point 24 of track 22 and generally vertically aligned with one of the bottom resting points 20. Track 23 also includes a vertical portion 29 extending upwardly from point 28 and generally paralleling vertical portion 25 of track 22. A small generally horizontal track portion 30 extends from the top of vertical track portion 29 to an arcuate track portion 31. The radius of curvature of arcuate track portion 31 is preferably that of an arc of a circle having its center at upper resting point 27 of track 22.

Bracket plate 14 includes a face surface 32 which in normal use is positioned adjacent to end 17 of plate 13. A plurality of apertures 33 (one shown in FIG. 3) are provided to receive the connecting components 21, as will be hereinafter described. Opposed upper and lower support flanges 34 and 35 extend outwardly from the top and bottom of face surface 32 and receive the bottom of mast 11, with collars 36 on opposed sides of flanges 34 and 35 positioning mast 11 in place.

Figure 3:
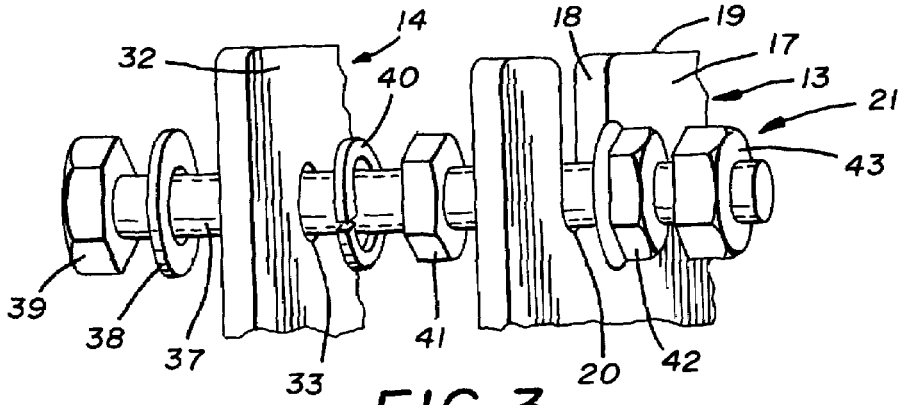
FIG. 3 is a fragmentary, perspective view of a connecting component of the system of the present invention.

As shown in FIG. 3, each connecting component 21 includes a bolt 37 which extends through each aperture 33 in bracket plate 14. A flat washer 38 is positioned between the hex head 39 of bolt 37 and bracket plate 14. A split lock washer 40 and a conventional hex nut 41 are positioned between face 32 of bracket plate 14 and end 17 of plate 13, and a flanged hex nut 42 and a locknut 43 are received on bolt 27 on the other side of plate 13.

Figure 2:
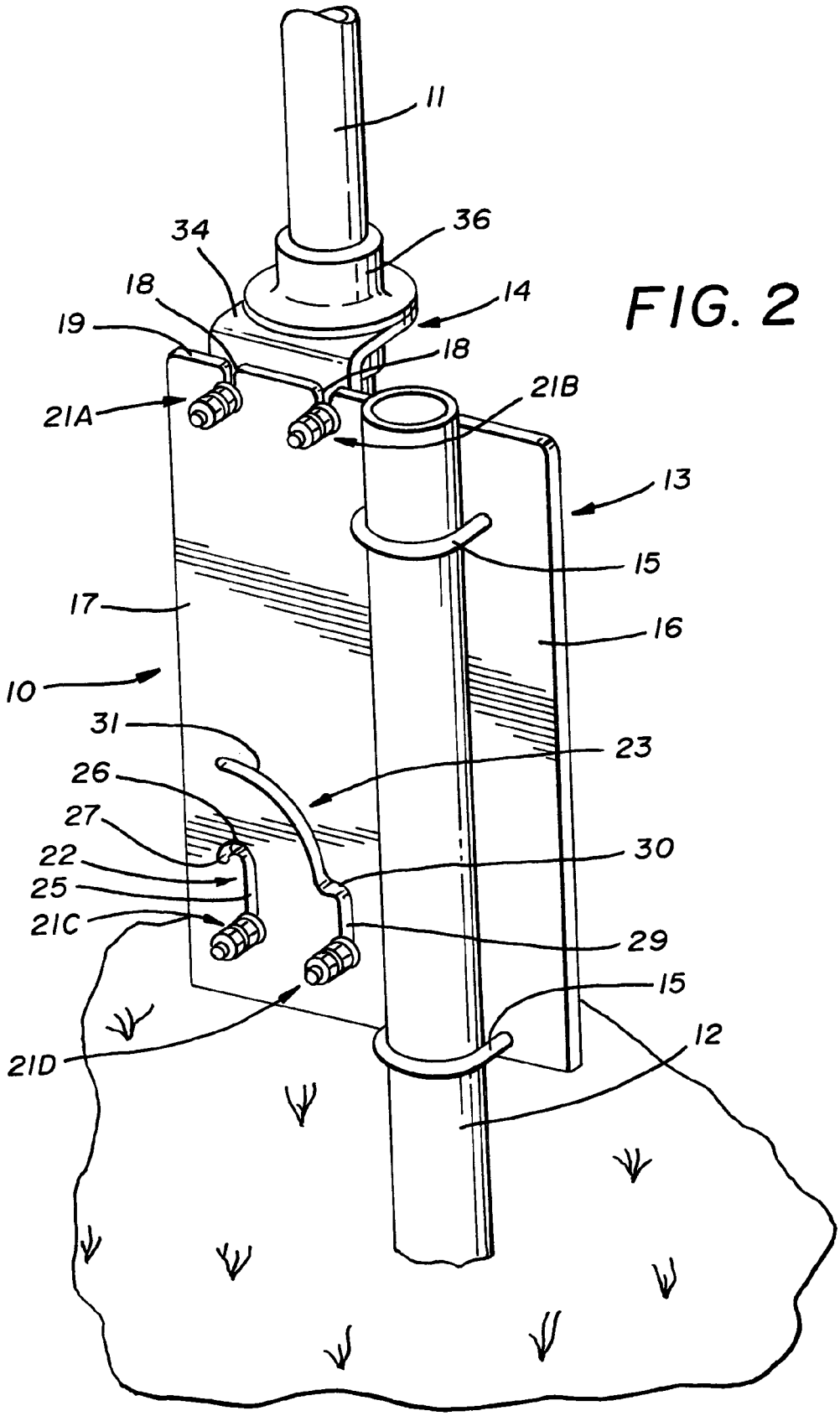
FIG. 2 is a fragmentary, rear perspective view of that which is shown in FIG. 1.

In order to assemble mast 11 to post 12, the four bolts are tightened to bracket plate 14 by tightening each nut 41. The two upper bolts 37 may be received in slots 18 at the bottom 20 thereof, and the two lower bolts may be received in tracks 22 and 23 at resting points 24 and 28, respectively. Then flanged nuts 42 may be tightened to effectively attach mast 11 to post 12, a condition shown in FIGS. 1, 2 and 4A. Locknuts 43 may then be threaded onto bolts 37, but they only need be positioned on the ends of the bolts 37, and not tight against flanged nuts 42, because the purpose of locknuts 43 is merely to prevent the flanged nuts 42 from coming off of bolts 37.

Figure 4A:
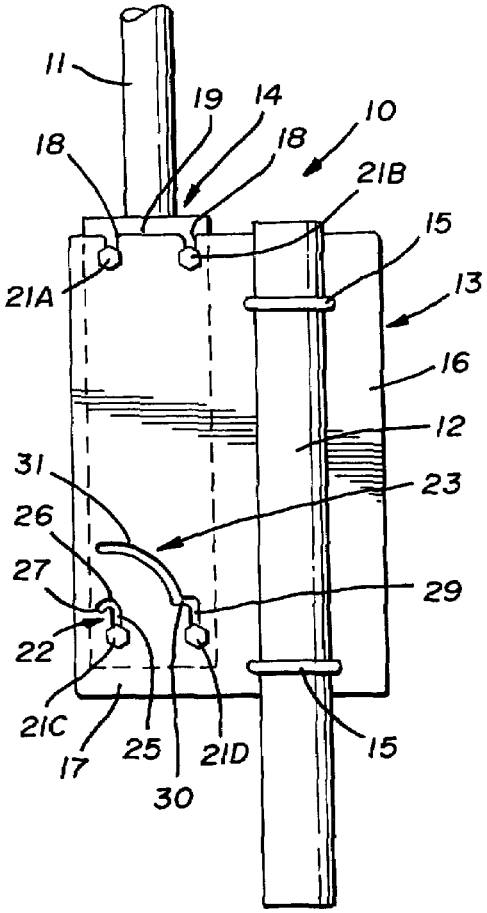
FIGS. 4A-4E are fragmentary, sequential, elevational views showing the manner in which the system is operated to tilt the mast of the antenna relative to the support post.
Figure 4B:
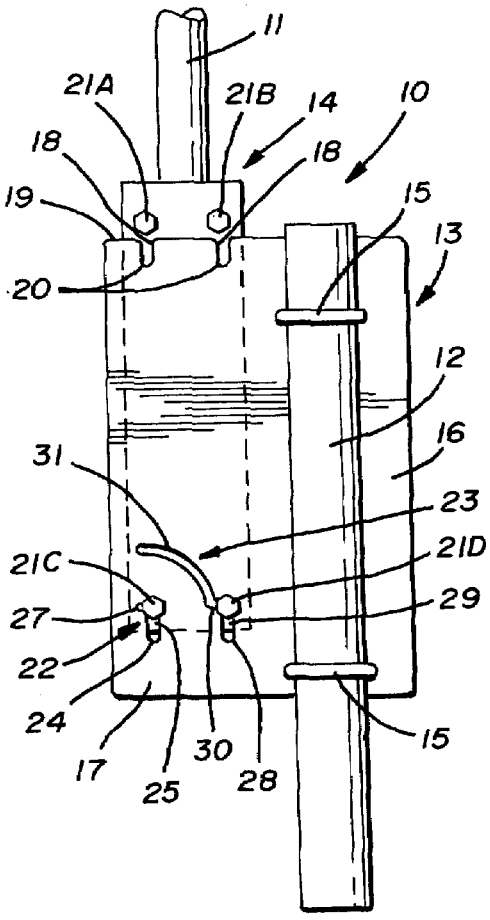

When it is desired to service the antenna, one merely needs to loosen flanged nuts 42 and follow the steps depicted in FIGS. 4A-4E. That is, FIG. 4A shows the normal, locked, upright position for antenna mast 11, but with nuts 42 loosened, mast 11 and bracket plate 14 may be lifted. As shown in FIG. 4B, this moves the bolts 37 of connecting components 21A and 21B out of notches 18 and moves bolts 37 of connecting components 21C and 21B upwardly along vertical track portions 25 and 29, respectively, to the tops thereof. Then the bracket plate may be moved laterally to the FIG. 4C position wherein bolt 37 of connecting component 21C is positioned in resting point 27 of track 22, and connecting component 21D is positioned at the transition between horizontal portion 30 and arcuate portion 31 of track 23.

Figure 4C:
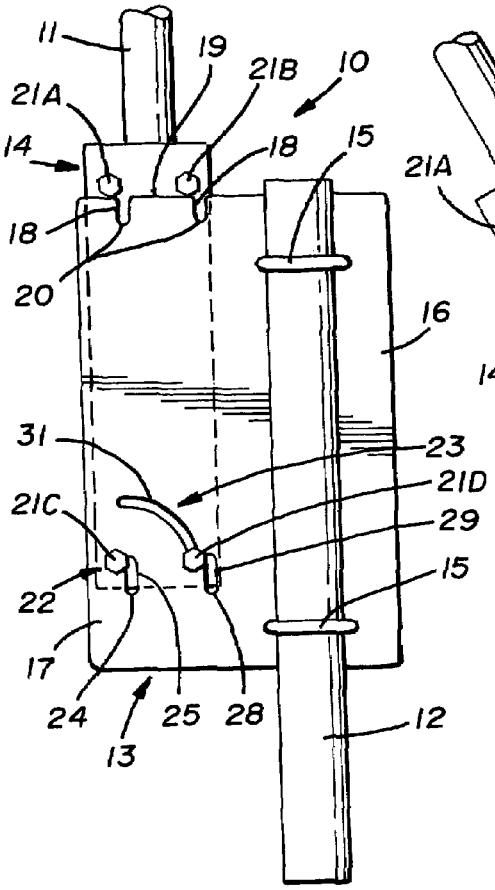
Figure 4D:
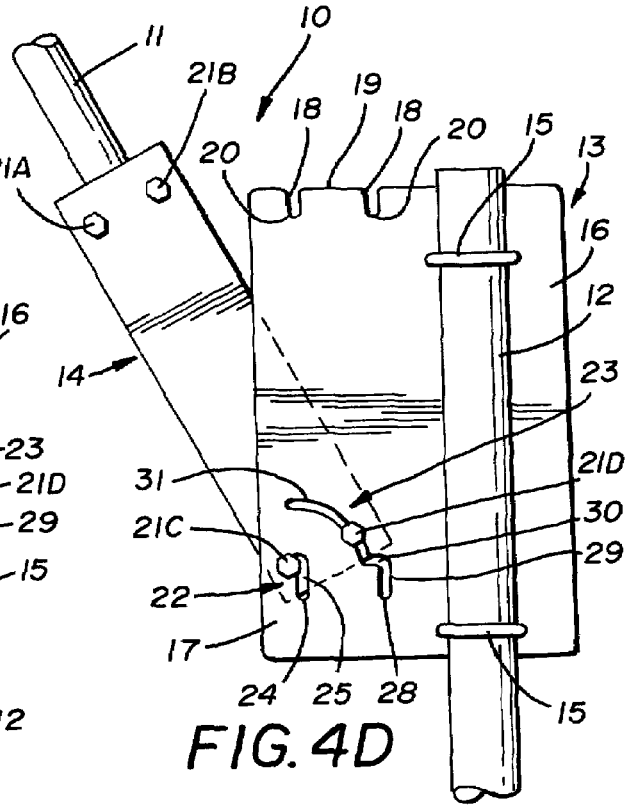
Figure 4E:
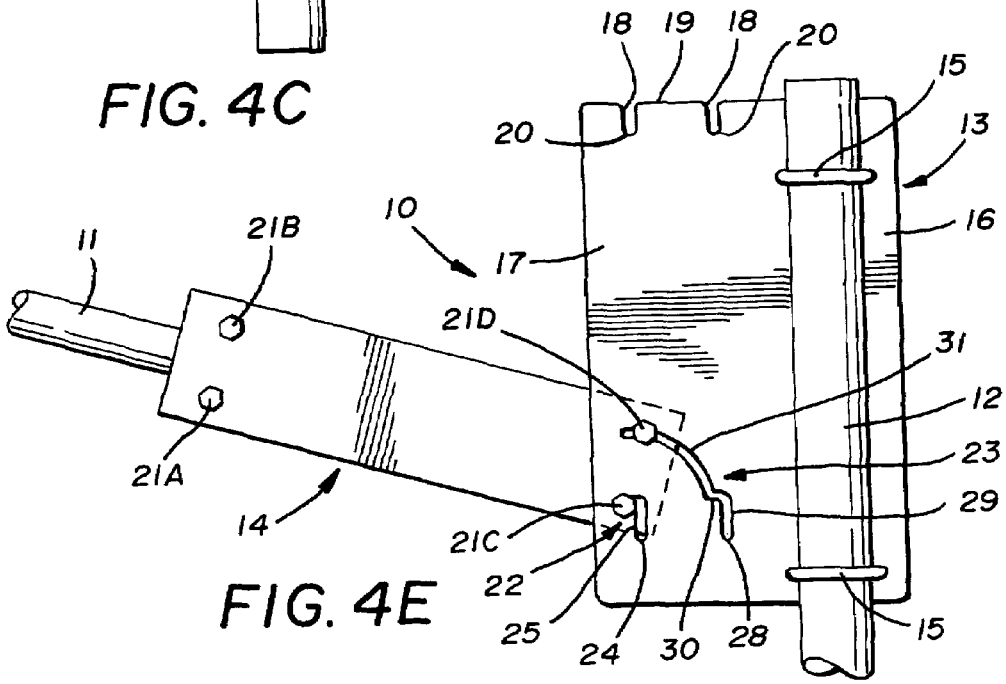

When so positioned, connecting component 21C, and in particular bolt 37 thereof, becomes a pivot point for antenna mast 11. Thus, as shown in FIGS. 4D and 4C, mast 11 and bracket plate 14 may be pivoted on connecting component 21C with the bolt 37 of connecting component 21D traveling in the arcuate portion of track 23. As such, the antenna at the top of mast 11 can be conveniently lowered under the control of one person and can thereafter be conveniently serviced or otherwise tuned, as desired. When that operation is completed, the process is reversed and with the components positioned as shown in FIG. 4A, flanged nuts 42 may be tightened to again affix mast 11 in the locked, upright position.

In view of the foregoing, it should be evident that a system constructed as described herein accomplishes the objects of the present invention and otherwise substantially improves the art.

What is claimed is:

1. A system for attaching the mast of an antenna to a support post comprising a first plate connected to the support post, a second plate carrying the mast, a plurality of connecting components which in one condition connect said first plate to said second plate and in another condition allow said second plate to be pivoted relative to said first plate, said pivot motion of said second plate being in a plane parallel to a face surface of said second plate, a first track in said first plate having a pivot point to receive one said connecting component, and a second track in said first plate having an arcuate portion to receive a second said connecting component, said second said connecting component moving in said arcuate portion when said second plate is pivoted relative to said first plate.

2. The system according to claim 1 wherein each said connecting component includes a bolt passing through said first plate and said second plate, a nut on said bolt between said first plate and said second plate, and a second nut on said bolt, said second nut, when tightened, establishing said one condition and, when loosened, establishing said another condition.

3. The system according to claim 1 further comprising a plurality of notches in said first plate, additional of said connecting components being received in said notches when said first plate is connected to said second plate.

4. The system according to claim 3 wherein said first and second tracks have resting points, said first and second said connecting components being positioned in said resting points when said first plate is connected to said second plate.

5. The system according to claim 4 wherein said first track includes a generally vertical portion extending between its said resting point and said pivot point, and said second track includes a generally vertical portion extending between its said resting point and said arcuate portion, said first and second connecting components moving in said vertical portions when said additional connecting components are being removed from said notches.

6. A system for attaching the mast of an antenna to a support post comprising a first plate connected to the support post, a second plate carrying the mast, and a plurality of connecting components for said plates enabling said first plate to be attached to said second plate and allowing said second plate to pivot relative to said first plate, said pivot motion being defined by a first track and a second track located on said first plate, said first track having a pivot point to receive one said connecting component, and said second track having an arcuate portion to receive a second said connecting component, said second said connecting component moving in said arcuate portion when said second plate is pivoted relative to said first plate.

7. The system according to claim 6 wherein each said connecting component includes a bolt passing through said first plate and said second plate, a nut on said bolt between said first plate and said second plate, and a second nut on said bolt, said second nut, attaching said first plate to said second plate and, when loosened, allowing said second plate to be pivoted relative to said first plate.

8. The system according to claim 7 wherein each said connecting component further includes a third nut to maintain said second nut on said bolt.

9. The system according to claim 6 further comprising a plurality of notches in said first plate, additional of said connecting components being received in said notches when said first plate is connected to said second plate.

10. The system according to claim 9 wherein said first and second tracks have resting points, said first and second said connecting components being positioned in said resting points when said first plate is connected to said second plate.

11. The system according to claim 10 wherein said first track includes a generally vertical portion extending between its said resting point and said pivot point, and said second track includes a generally vertical portion extending between its said resting point and said arcuate portion, said first and second connecting components moving in said vertical portions when said additional connecting components are being removed from said notches.

12. A system for attaching the mast of an antenna to a support post comprising a first plate connected to the support post, a second plate carrying the mast, said first plate having a first track defining a pivot point and a second track having an arcuate portion, and a plurality of connecting components selectively connecting said first plate to said second plate and allowing said second plate to be pivoted relative to the said first plate, one said connecting component being in said first track and another said connecting component being in said second track such that when said connecting components are not connecting said plates, said second plate can pivot relative to said first plate.

13. The system according to claim 12 further comprising a plurality of notches in said first plate, additional of said connecting components being received in said notches when said first plate is connected to said second plate.

14. The system according to claim 13 wherein said first and second tracks have resting points, said first and second said connecting components being positioned in said resting points when said first plate is connected to said second plate.

15. The system according to claim 14 wherein said first track includes a generally vertical portion extending between its said resting point and said pivot point, and said second track includes a generally vertical portion extending between its said resting point and said arcuate portion, said first and second connecting components moving in said vertical portions when said additional connecting components are being removed from said notches.

16. The system according to claim 12 wherein each said connecting component includes a bolt passing through said first plate and said second plate, a nut on said bolt between said first plate and said second plate, and a second nut on said bolt, said second nut, when tightened, establishing said one condition and, when loosened, establishing said another condition.

17. The system according to claim 16 wherein each said connecting component further includes a third nut to maintain said second nut on said bolt.

18. A method of attaching the mast of an antenna to a support post comprising the steps of attaching a first plate to the post, attaching a second plate to the mast, and connecting the first plate to the second plate so that the second plate can either be attached to the first plate or pivoted relative to the first plate, wherein the step of connecting includes the step of passing bolts through notches formed in the first plate and through tracks formed in the first plate.

19. The method of claim 18 wherein the second plate is attached to the first plate by tightening nuts on the bolts, and the second plate can be pivoted relative to the first plate after the nuts are loosened.

20. The method of claim 19 further comprising the step of lifting the mast to remove the bolts from the notches and to move the bolts in the tracks.

21. The method of claim 20 further comprising the step of pivoting the mast relative to the post to pivot one of the bolts in one of the tracks about another of the bolts in the other of the tracks.

* * * * *